US007500561B2

(12) United States Patent
Matias et al.

(10) Patent No.: US 7,500,561 B2
(45) Date of Patent: Mar. 10, 2009

(54) ADJUSTABLE CUSHIONING SYSTEM FOR CARRYING CASE

(75) Inventors: Edgar Matias, Toronto (CA); Stephen R. McGowan, Newmarket (CA)

(73) Assignee: The Matias Corporation, Vaughan, Ontario (CA)

( * ) Notice: Subject to any disclaimer, the term of this patent is extended or adjusted under 35 U.S.C. 154(b) by 213 days.

(21) Appl. No.: 10/748,329

(22) Filed: Dec. 31, 2003

(65) Prior Publication Data

US 2005/0145528 A1 Jul. 7, 2005

(51) Int. Cl.
*B65D 85/30* (2006.01)

(52) U.S. Cl. ..... 206/320; 206/523; 206/586; 206/593

(58) Field of Classification Search ..... 206/320, 206/523, 576, 371, 316.2, 585, 586, 593, 206/814, 521; 150/165; 190/900, 103, 110, 190/125

See application file for complete search history.

(56) References Cited

U.S. PATENT DOCUMENTS 3,456,783 A * 7/1969 Clark ..... 206/443
3,943,572 A * 3/1976 Aileo ..... 2/415
4,586,602 A * 5/1986 Levey ..... 206/3
4,771,882 A * 9/1988 Lowe et al. ..... 206/268
4,884,692 A * 12/1989 Middlebrooks ..... 206/308.3
4,899,888 A 2/1990 Shawler
5,090,562 A 2/1992 Grullemans
5,117,952 A * 6/1992 Suh ..... 190/127
5,769,221 A * 6/1998 Cyr ..... 206/316.1
5,769,232 A 6/1998 Cash
5,857,568 A 1/1999 Speirs
5,960,952 A 10/1999 Chen
6,073,770 A * 6/2000 Park ..... 206/522
6,145,661 A * 11/2000 Jung ..... 206/320
6,334,533 B1 1/2002 Hollingsworth
6,334,534 B1 1/2002 Hollingsworth et al.
6,899,946 B2 * 5/2005 Geary et al. ..... 206/523
2004/0004016 A1 * 1/2004 Rawat ..... 206/449

FOREIGN PATENT DOCUMENTS

WO WO 99/39607 8/1999

* cited by examiner

*Primary Examiner*—J. Gregory Pickett
(74) *Attorney, Agent, or Firm*—Perry + Currier Inc.; Stephen J. Perry

(57) ABSTRACT

An adjustable cushioning system, for use in a carrying case or the like, adapted to be re-sized internally to match the size and shape of its contents. Shock-absorbent spacers are stacked against the walls of the case or bag to adjust the internal dimensions of the case or bag as desired.

5 Claims, 2 Drawing Sheets

ADJUSTABLE CUSHIONING SYSTEM FOR CARRYING CASE

FIELD OF THE INVENTION

The present invention relates generally to carrying cases or bags, for safely transporting delicate instruments, such as computers, and more particularly to impact resistant cushions for use in carrying cases.

PRIOR ART

Laptop computers vary widely in size and shape, depending on the features engineered into them by their manufacturers. This variation makes it difficult for carrying case manufacturers to design cases which offer adequate protection against accidental drops, yet still fit the wide variety of laptops available.

Most laptop cases have foam padding surrounding the internal cavity, which holds the laptop. The cavity is sized to fit a certain range of different-sized laptops, but it never perfectly matches all laptops. Invariably, there is some room left within the carrying case, such that the laptop is susceptible to damaging impact in the event of an accidental drop.

A common approach to addressing the above problem is disclosed in U.S. Pat. No. 5,960,952, wherein a laptop is strapped into a briefcase and a single moveable foam bar is used to separate the laptop from its associated accessories. The foam bar is not held firmly in place and offers little protection in the event of a fall. Also, since the laptop is not centered in the case, weight distribution is uneven, making it somewhat awkward to carry.

An improvement is disclosed in U.S. Pat. No. 6,334,533, wherein two adjustable cushion segments are described, one of which can be positioned laterally to change the internal width of the case to fit the width of the laptop. However, the laptop is still off-center and the height of the internal case cavity is not adjustable.

U.S. Pat. No. 5,857,568 discloses another solution, whereby an adjustable frame is used to re-size the inside of the case to match the size and shape of the laptop. The laptop remains centered, ensuring even weight distribution. While this invention does address the problems identified above, it is mechanically complicated. The user of this case would need tools to configure it properly, and the additional weight of the frame places an undue burden on the user who is already encumbered by the weight of the laptop.

U.S. Pat. No. 5,769,232 describes an inflatable protective lining system for shipping containers. Depending on the degree of inflation, the lining can be adjusted to hold the enclosed article suspended within the container.

SUMMARY OF THE INVENTION

According to the present invention, an adjustable cushioning system is provided for use in a carrying case or the like, adapted to be re-sized internally to match the size and shape of its contents. Shock-absorbent spacers are stacked against the walls of the case or bag to adjust the internal dimensions of the case or bag as desired.

BRIEF INTRODUCTION TO THE DRAWINGS

A detailed description of the invention is set forth herein below, with reference to the following drawings, in which.

DESCRIPTION OF THE INVENTION

As used herein, "carrying case" means any case or bag for carrying fragile items such as laptop computers, whether such case or bag has soft or rigid exterior walls.

Figure 1:
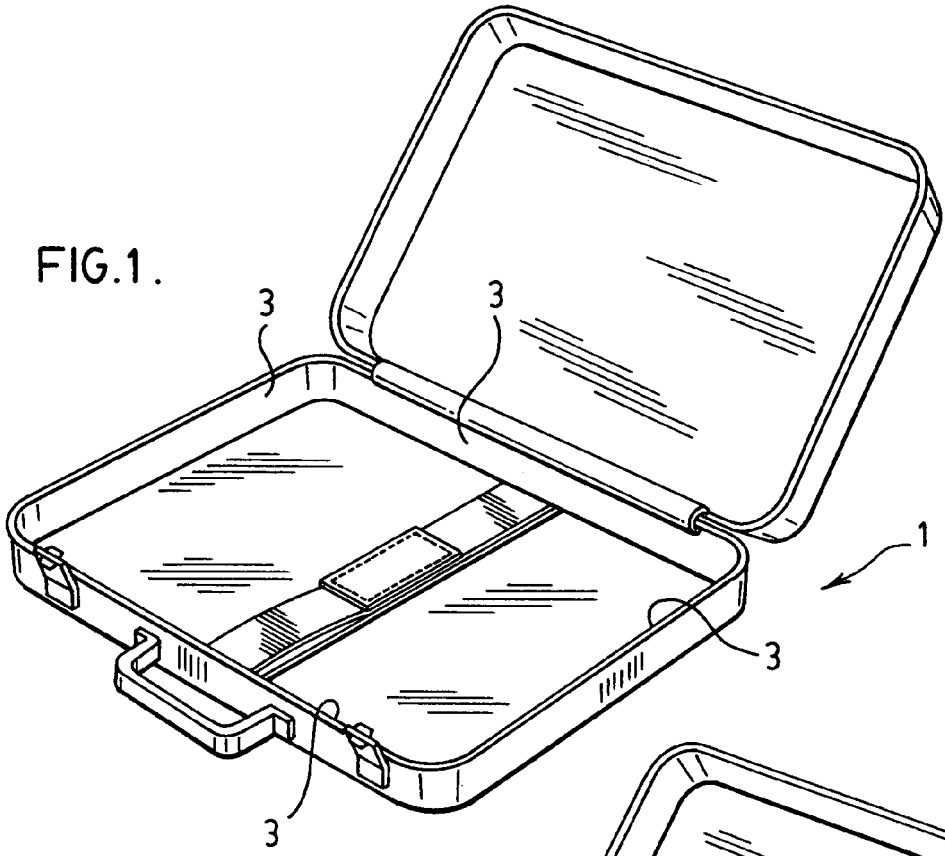
FIG. 1 shows a carrying case according to one aspect of the present invention.

FIG. 1 shows a carrying case 1 of arbitrary size suitable for carrying a laptop computer or the like. The internal sides 3 of the case are lined with an adhesive material, such as hook and loop fasteners sold under the trademark Velcro®, or other suitable adhesive material.

Figure 2:
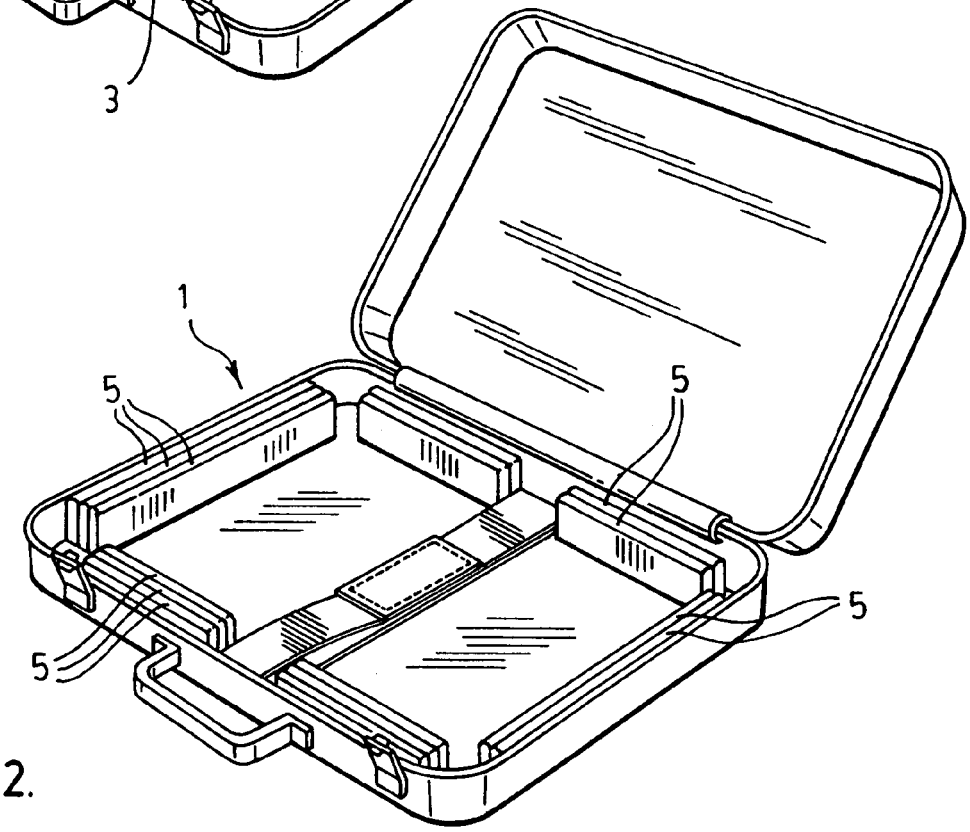
FIG. 2 shows the carrying case of FIG. 1 with a plurality of stackable, shock-absorbent spacers according to another aspect of the present invention.

As shown in FIG. 2, a plurality of shock-absorbent spacers 5 are stacked against the walls of the case (as many as necessary) to adjust the internal dimensions of the case to fit the size and shape of the object enclosed.

By varying the number of spacers, the user can adjust the internal dimensions to snugly fit any size of laptop that is not larger than the case or bag itself. No tools are required to perform this adjustment. The spacers can be pulled apart with only a slight effort.

Figure 3:
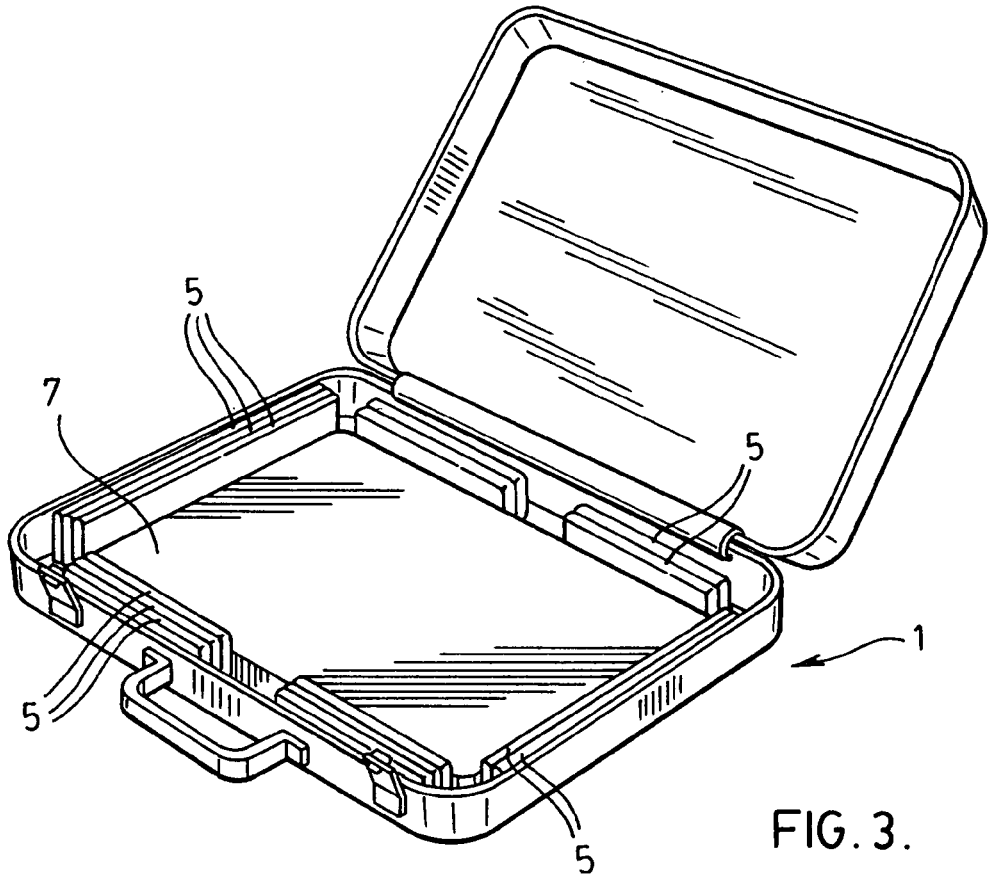
FIG. 3 shows the carrying case of FIGS. 1 and 2 with a laptop computer fit snugly therewithin.

As shown in FIG. 3, the laptop 7 remains centered within the case 1, its weight evenly distributed, for greater carrying comfort.

Figure 4:
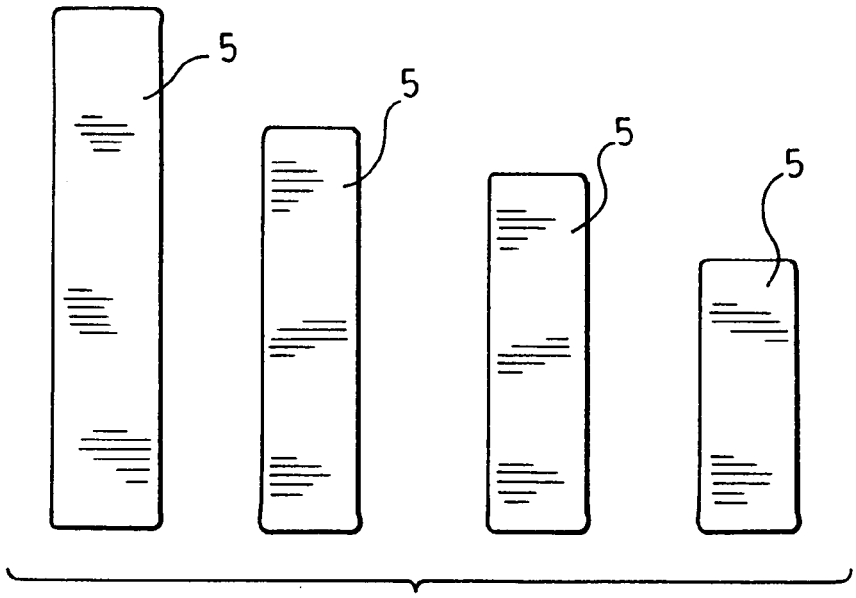
FIG. 4 shows a plurality of spacers of different sizes and shapes, according to the present invention.

With reference to FIG. 4, the spacers are preferably fabricated from a lightweight foam cushion material, which imposes no noticeable weight burden on the user, yet still acts as an effective shock-absorber in the event the carrying case is accidentally dropped. On at least one side (preferably opposite sides) is a hook and loop fastening system (e.g. hooks on one side and loops on the opposite side), such as sold under the trademark Velcro®. The shape of each spacer 5 is preferably a parallelepiped, although other suitable shapes may be used (e.g. cylindrical rolls, etc.)

A person understanding the present invention may conceive of other embodiments or variations, all of which are believed to be within the sphere and scope of the invention as defined by the claims appended hereto.

What is claimed is:

1. A carrying case with adaptable internal dimensions for accommodating a laptop computer, comprising:

a plurality of internal side walls, said plurality of internal side walls including one of either a hook or loop fastener; and a plurality of stackable shock-absorbent spacers for insertion between the side walls and said laptop computer;

each of said spacers lying substantially parallel to a portion of one of said side walls, said portion beginning distal to the junction between a first side wall and a second side wall, and terminating prior to the junction between said first side wall and a third side wall;

wherein a hook and loop fastening system is provided to couple at least one of said plurality of stackable shock-absorbent spacers to at least one of said plurality of internal side walls and to couple adjacent ones of said stackable shock-absorbent spacers to one another.

2. The carrying case of claim 1, wherein each of said stackable shock-absorbent spacers comprises an impact absorbing.

3. The carrying case of claim 2, wherein said hook and loop fastening system comprises one of either a hook or loop fastener on one side of said impact absorbing body and the other of said hook or loop fastener on an opposite side of said impact absorbing body.

4. The carrying case of claim 2, wherein said impact absorbing body is a light-weight foam cushion.

5. The carrying case of claim 4, wherein said cushion is of generally parallelepiped shape.

* * * * *